United States Patent [19]

Gorman

[11] 4,437,251

[45] * Mar. 20, 1984

[54] FULL GAIN TWIST RATCHET RIFLING

[76] Inventor: Richard M. Gorman, 3420 W. Danbury St., Apt. C-106, Phoenix, Ariz. 85023

[ * ] Notice: The portion of the term of this patent subsequent to Jan. 5, 1999 has been disclaimed.

[21] Appl. No.: 332,801

[22] Filed: Dec. 21, 1981

Related U.S. Application Data

[63] Continuation-in-part of Ser. No. 130,383, Mar. 14, 1980, Pat. No. 4,308,681.

[51] Int. Cl.[3] ..... F41C 21/00

[52] U.S. Cl. ..... 42/78

[58] Field of Search ..... 42/78

[56] References Cited

U.S. PATENT DOCUMENTS

| | | | |
|---|---|---|---|
| 338,192 | 3/1886 | Rubin | 42/78 |
| 835,482 | 11/1906 | Vulpius | 42/78 |
| 4,308,681 | 1/1982 | Gorman | 42/78 |

*Primary Examiner*—Charles T. Jordan
*Assistant Examiner*—Ted L. Parr
*Attorney, Agent, or Firm*—John F. McClellan, Sr.

[57] ABSTRACT

Improved ratchet rifling with a full gain twist is provided in the form of a bore portion having a smooth bore for initially receiving and holding a projectile without marring the projectile followed by gradually emerging ratchet rifling contour with each spin-imparting edge progressively deepening, at least by crest or minor-radius portions "falling" inward toward the axis of the bore and as an alternative by base or major-radius portion increasing in distance from the bore axis, in either case resulting in projectile-seating increasing in predetermined proportion to twist along the barrel.

10 Claims, 9 Drawing Figures

FULL GAIN TWIST RATCHET RIFLING

This application is a continuation-in-part of my copending application, Ser. No. 130,383, filed Mar. 14, 1980 for PROGRESSIVE RATCHET RIFLING IN A FULL GAIN TWIST, U.S. Pat. No. 4,308,681.

This invention relates generally to firearms and particularly to improved full gain twist ratchet rifling in barrels of firearms.

MY PRIOR DISCLOSURE

My copending application discloses rifling which as it leads towards the muzzle begins with relatively shallow, narrow, generally rectangular shape lands in cross-section, and longitudinally relatively parallel with the bore, and progresses in continuous transition and accelerating spiral through intermediate positions in which each groove, in cross-section, inclines deeper at the leading edge of one adjacent land and shallower at the other adjacent land until at the muzzle-end of the rifling each land has in cross-section only one lateral face, the leading edge, and in cross-section inclines in an outwardly circumferential direction to a terminus at the root of the next land.

The system can be used throughout the whole length of a barrel or a partial length.

OBJECTS OF THE INVENTION

A principal object of this invention is to provide a simplified rifling system which preserves advantages of my said copending application, which seats the bullet to a predetermined depth on the spin-imparting edge of the rifling, and which eliminates as many lines or other rifling caused deformities on the projectile as possible.

A further object is to provide a rifling system in which the minor radius as measured outwardly from the axis of the bore tapers constrictingly towards the muzzle, beginning with a smooth bore portion and proceeding through accelerating rifling commencing nearly parallel with it, through a full gain twist, and in which the major radius can lengthen progressively along the barrel towards the muzzle or can remain substantially constant or can decrease.

Yet a further object is to provide a rifling system which, through the structural provisions recited, improves projectile velocity, stability and accuracy.

BRIEF SUMMARY OF THE INVENTION

The present invention is analogous in many respects to my copending application invention; differences include that a portion of the rifling cross-sectional shape is omitted so that the finished rifling can initiate from a smooth-bore and progress into accelerating ratchet rifling with smallest-radius constricting progressively towards the muzzle.

The above and other objects and advantages of this invention will become more readily apparent on examination of the following description including the drawings in which the like characters refer to like parts.

Figure 7:
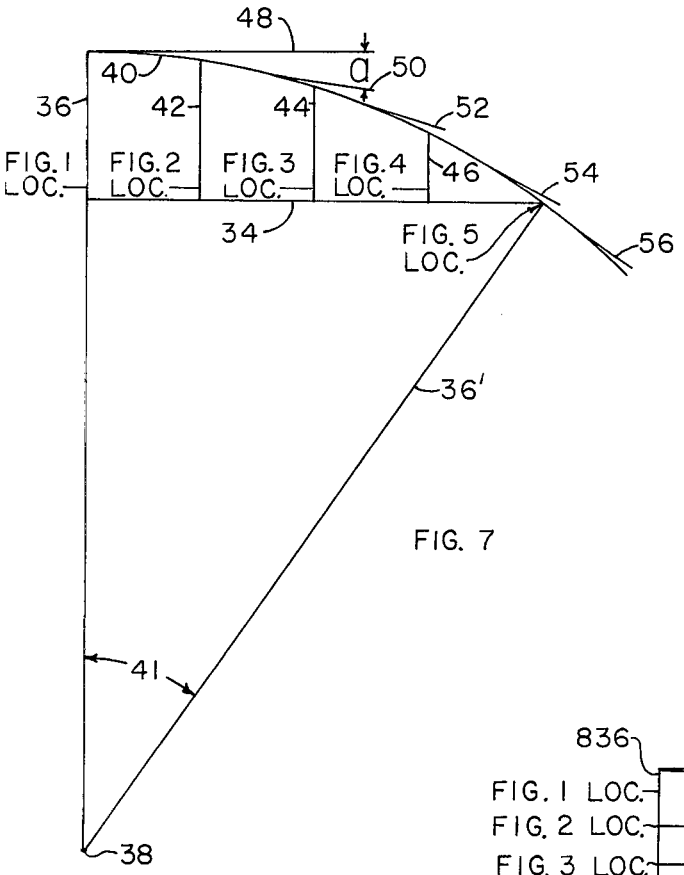

FIGS. *6a* and *6b* are similar-view fragmentary diagrams of optional-embodiment, anti-fin-forming rifling contours, aaccording to this invention;

FIG. 7 is an exaggerated diagram of rifling spiral acceleration; and

Figure 8:
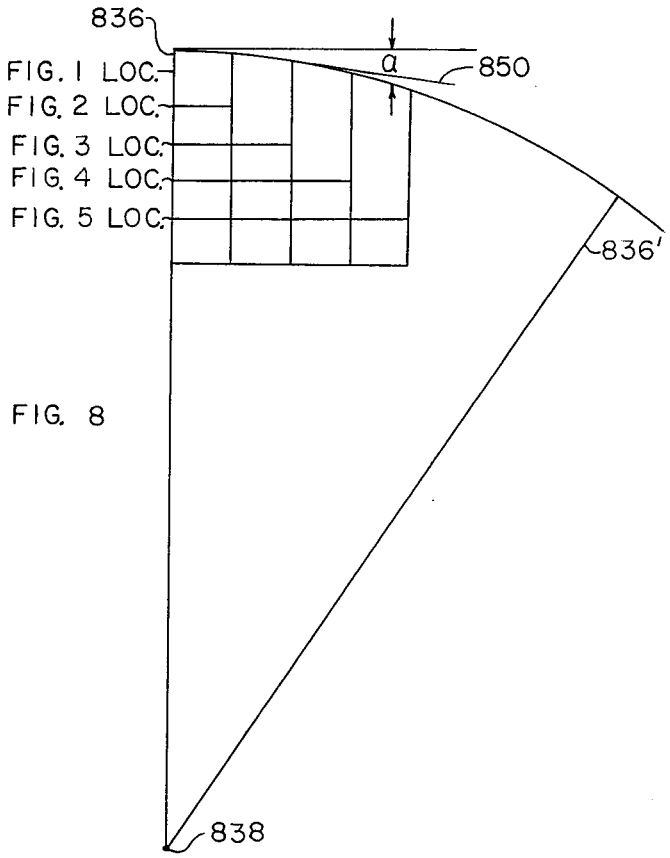

FIG. 8 is an exaggerated diagram of a curve shown in generally similar manner to that of FIG. 7.

DETAILED DESCRIPTION

Figure 1:
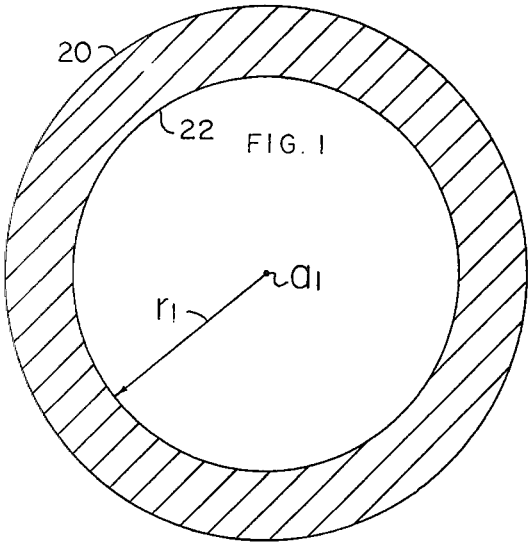
FIGS. 1 through 5 are exemplary exaggerated successive-location cross-sectional diagrams as viewed from the breech towards the muzzle, with spiralling omitted for easier comparison.

FIG. 1 shows that the barrel 20 of the invention has at the rearmost end or breech end of the projectile-fitting portion a bore surface defining a cylindrical smooth bore 22 or constant radius ($r_1$) bore. As indicated in the next Figure, this circular contour immediately goes into ratchet rifling shape.

Figure 2:
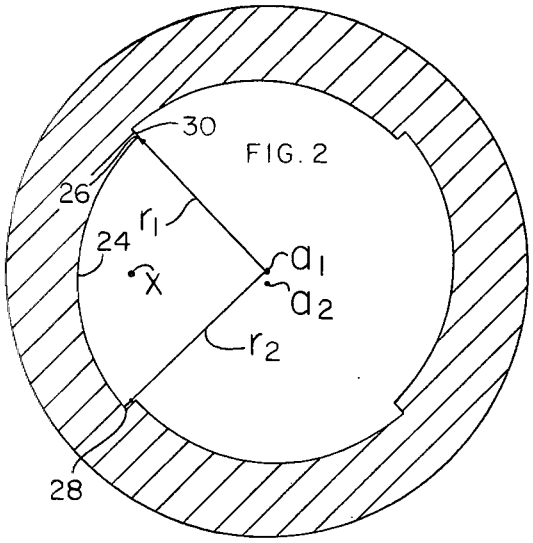

FIG. 2 shows in exaggerated detail that smoothly emerging from the smooth bore portion and preferably equally spaced circumferentially about the bore are very shallow or gradually inclined rifling contours, 24 shown, concave inwardly from crest 26 to base 28, each rotated about an arbitrary point X.

Figure 4:
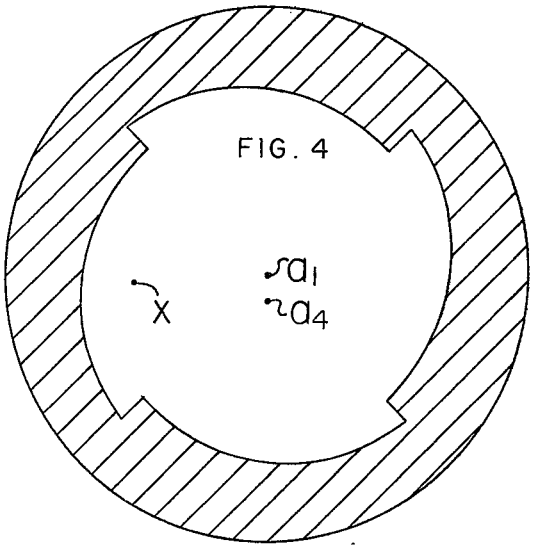
Figure 5:
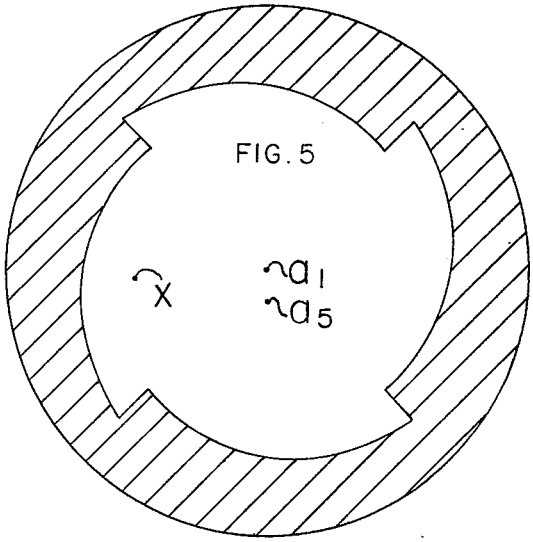
Figure 3:
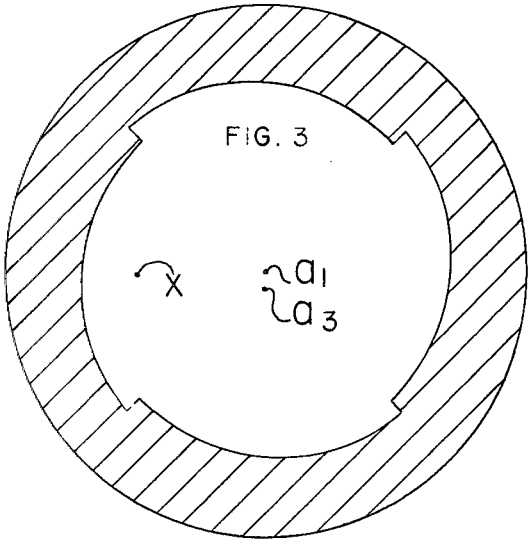
Figures 6A, 6B:
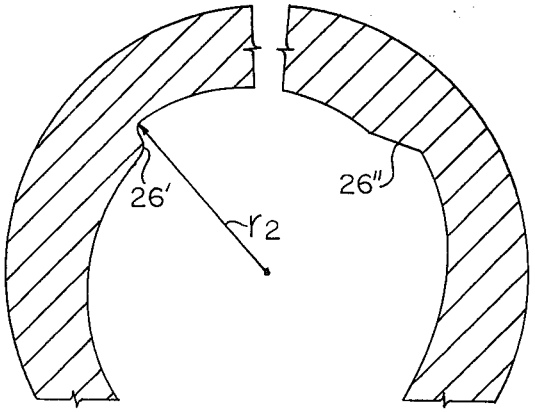

FIGS. 3–5 shows in exaggerated detail that these contours rotate progressively through succeeding locations towards the muzzle.

As the rifling contours rotate, each shifts its own center of curvature from "$a_1$", the bore axis shown in FIG. 1, progressively in an arc as at $a_2$, $a_3$, $a_4$, $a_5$, FIGS. 2, 3, 4, 5 respectively. This rotation causes each spin-imparting edge 30 to lengthen in a generally inward direction. As indicated, in selected circumstances it can lengthen in an outward direction also; but the top of the step or crest 26 of the spin-imparting edge, always falls inward in a direction generally towards the respective shifted center of curvature as the rifling progresses and this is what causes the minor radius $r_1$ from the bore axis to the crest of the rifling to shorten and the bore to taper inwardly along the barrel.

The major radius $r_2$ from the bore axis to the base of the rifling of the bore may remain constant or it may, as shown, enlarge (grow progressively longer) depending on the location of point "x". No clear cut advantages between these aspects have been observed; each coacts in the combination of this invention in seating the projectile and imparting spin.

As an example of concurrent change inwardly of the crest 26 of the spin imparting edge, and outwardly, of the base 28 of the spin imparting edge, the dimensions may be in proportion:

| | minor radius ($r_1$) | major radius ($r_2$) |
|---|---|---|
| FIG. 1 | .308/2 | .308/2 |
| FIG. 2 | .306/2 | .310/2 |
| FIG. 3 | .304/2 | .312/2 |
| FIG. 4 | .302/2 | .314/2 |
| FIG. 5 | .300/2 | .316/2 |

FIGS. *6a* and *6b* correspond to FIG. 5 and show in exaggerated detail the case in which the major radius $r_2$ has remained constant, and additionally each shows an alternative shape for the spin imparting edge which may be a radiused or rounded crest as at 26', FIG. *6a*, or a substantially planar contour inclined to a radius passing through it as at 26'', FIG. *6b*. Again, no particular advantage of one over the other is known. Each coacts in the combination of this invention in imparting spin to the projectile.

FIG. 7 exaggeratedly diagrams points on the spiral rifling acceleration curve; the acceleration may be according to this invention concurrent with the rifling-contour rotation described. The following describes it as being concurrent. The rifled bore is diagrammed as a half-chord 34 perpendicular to the "Y" axis 36 which is a radius extending from point 38 below the chord and describing an arc 40. Length of the radius is chosen as a function of desired rifling helix or spiral acceleration curve, the shorter the radius the sharper the acceleration curve, all other things remaining constant.

At uniform distances along the chord 34 respective lines 42, 44, 46 are drawn perpendicular to it and extending to the arc 40. The radius and these lines represent the locations of the views of the respective Figures. The angles (as shown) between line 34 and the respective tangents 48, 50, 52, 54, 56 to the arc 40 at the intersection of the radius and of each of these lines represents the spiral or helix angle or angle of twist of the rifling at that point. Similarly the angle between the radius 36 and another radius (36' shown) through one of the points of tangency represents the local helix angle of the rifling, as indicated at 41.

The effect of this curve is to provide a uniform increase of spiral with distance along the barrel.

FIG. 8 shows in exaggerated detail an alternative curve like that of FIG. 7 but without the correlation of acceleration with progressive change of rifling contour along the full length of the rifling. Instead, the full progressive change of rifling contour may be completed at any position from the beginning at the "FIG. 1 location" 836 onward. For example, as shown here, the transition through the FIG. 2 through FIG. 5 locations may be completed much earlier in the acceleration curve at 850, as indicated at the FIG. 5 location notation.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United State Letters Patent is:

1. In a barrel having progressive ratchet rifling in a full gain twist along a portion of the bore thereof for imparting spin to a projectile, the improvement comprising: means for minimizing formation of unwanted rifling-caused deformities in a said projectile, including a first part of said bore having constant radius from the bore axis defining a smooth bore for positioning a projectile free of rifling-caused deformities, a second part of said bore having ratchet rifling with a plurality of spin-imparting edges spaced circumferentially in the bore, in cross-section each spin-imparting edge having a crest, which defines minor radius of rifling contour from the bore axis and a base which defines major radius of rifling contour from the bore axis; and means for increasing depth of projectile spin-imparting engagement with said rifling in proportion to projectile angular acceleration comprising means progressively lengthening the spin imparting edge along said second part of the barrel including: said second part of the bore beginning at said first part of the bore with both minor radius and major radius and continuing along said second part of the bore with said minor radius progressively lessening.

2. In a barrel as recited in claim 1, said major radius being constant along said second part of the bore.

3. In a barrel as recited in claim 1, and said major radius progressively increasing along said second part of the bore.

4. In a barrel as recited in claim 1, each said rifling contour extending from respective crest to base as a concave arc, each said concave arc having a center of curvature at a selected location towards said axis of the bore, and said selected location shifting in an arcuate path in synchronism with said progressive-lessening of the minor radius.

5. In a barrel as recited in claim 4, said minor radius progressive-lessening along said second part of the bore continuing synchronously through said full gain twist.

6. In a barrel as recited in claim 4, said minor radius progressive-lessening continuing along said second part of the barrel a distance short of completion of said full gain twist.

7. In a barrel as recited in claim 1, said spin-imparting edge having a rounded contour.

8. In a barrel as recited in claim 1, said spin-imparting edge having a substantially planar contour inclined to a radius of the barrel passing therethrough.

9. In a rifled barrel with means for seating a projectile therein, said rifled barrel having minor and major-radius portions measured from the bore-axis, and having therebetween spin-imparting edges on the rifling, in combination: improved ratchet rifling with a full gain twist in the form of a bore portion having a smooth bore for initially receiving and holding a projectile without marring the projectile followed by a gradually emerging ratchet rifling contour with each spin-imparting edge being progressively deepened by said minor-radius portions "falling" inward toward said bore axis and producing a projectile-seating increasing in predetermined proportion to twist along the barrel.

10. In a rifled barrel as recited in claim 9, said spin-imparting edges being progressively deepened also by said major-radius portions increasing.

* * * * *